US010913589B2

(12) United States Patent
George et al.

(10) Patent No.: US 10,913,589 B2
(45) Date of Patent: Feb. 9, 2021

(54) COMPRESSION RESISTANT PACKAGE FOR WALL AND CEILING TILE

(71) Applicant: Tower IPCO Company Limited, Mahon (IE)

(72) Inventors: Steve George, Tigard, OR (US); Sun Qiong, Zhangjiagang (CN)

(73) Assignee: TOWER IPCO COMPANY LIMITED

( * ) Notice: Subject to any disclaimer, the term of this patent is extended or adjusted under 35 U.S.C. 154(b) by 379 days.

(21) Appl. No.: 16/006,133

(22) Filed: Jun. 12, 2018

(65) Prior Publication Data

US 2019/0210784 A1 Jul. 11, 2019

Related U.S. Application Data

(60) Provisional application No. 62/613,786, filed on Jan. 5, 2018.

(51) Int. Cl.
*B65D 81/05* (2006.01)
*B65D 85/46* (2006.01)

(52) U.S. Cl.
CPC ..... *B65D 81/054* (2013.01); *B65D 85/46* (2013.01); *B65D 2581/055* (2013.01)

(58) Field of Classification Search
CPC ..... B65D 81/00; B65D 81/02; B65D 81/05; B65D 81/053; B65D 81/054; B65D 81/107
See application file for complete search history.

(56) References Cited

U.S. PATENT DOCUMENTS

| | | | | |
|---|---|---|---|---|
| 8,777,007 | B2 * | 7/2014 | Chen | B65D 1/34 206/454 |
| 10,518,499 | B2 * | 12/2019 | Belanger | B32B 21/06 |
| 2003/0052037 | A1 * | 3/2003 | Baechle | B65D 81/054 206/586 |
| 2005/0155904 | A1 * | 7/2005 | Chen | B65D 5/643 206/719 |
| 2011/0135874 | A1 * | 6/2011 | Van Berlo | B65D 81/053 428/121 |

* cited by examiner

*Primary Examiner* — Steven A. Reynolds
*Assistant Examiner* — Javier A Pagan
(74) *Attorney, Agent, or Firm* — Rodman and Rodman LLP

(57) ABSTRACT

The compression resistant package for wall and ceiling tile includes a first container having a box portion and a cover. An L-shaped corner protection member is provided inside the box portion at each of the tour corners of the box portion. Each of the L-shaped corner protection members have two intersecting legs that respectively extend alongside predetermined portions of the interior wall surfaces of the box portion. The corner protection members have a height that extends upwardly from the floor of the box portion to the height of the walls of the box portion. The corner protection members are formed of a compression resistant material that prevents any overlying containers from imposing pressure on a stack of tiles inside the first container when the stack height of the tiles inside the first container is less than the height of the corner protection members.

20 Claims, 5 Drawing Sheets

COMPRESSION RESISTANT PACKAGE FOR WALL AND CEILING TILE

BACKGROUND OF THE INVENTION

1. Field of the Invention

This invention is directed to protective packaging for wall and ceiling tile, and more particularly to a novel compression resistant package for wall and ceiling tile.

When known cardboard packages of tiles are stacked one upon another, such as upon a pallet or shelf, during shipment or storage, underlying tile packages can be compressed andlor deformed by the cumulative weight of overlying tile packages. If an underlying tile package is deformed due to weight compression of overlying tile packages, the compressive forces are also usually exerted on the tiles inside the underlying packages.

One type of wall and ceiling tile, as shown in U.S. patent application Ser. No. 15/208,084, the disclosure of which is hereby incorporated by reference, has an adhesive tape securement system. The adhesive tape securement system includes strips of double-sided adhesive tape with a foam core having a thickness of approximately 1/32 of an inch. If the double-sided adhesive tape strips are compressed, the thickness of foam core will become reduced. When compression of the double-sided adhesive tape is relieved the thickness of the foam core may rebound or expand. However, depending upon the amount of time that the double-sided adhesive tape strips are subject to compression, the foam core can obtain a compression set and may not rebound to its original normal thickness.

Compressive forces over an extended period of time on packaged tiles with foam core adhesive tape strips can permanently reduce the normal thickness of the foam core and thus permanently reduce the normal overall thickness of the double-sided adhesive tape strips. A reduced thickness of the double-sided adhesive tape strips can cause difficulties in adhering the tile to a wall or ceiling surface.

It is thus desirable to prevent any reductions in the normal thickness of foam based adhesive tape strips due to compressive forces on tile packages, when the tile packages are stacked one upon another during storage or shipment. It is also desirable to protect the tiles from any corner impact or side or end impact imposed on the tile package.

DESCRIPTION OF THE DRAWINGS

In the accompanying drawings.

Corresponding reference numbers indicate corresponding parts throughout the several views of the drawings.

DETAILED DESCRIPTION OF THE INVENTION

Figure 1:
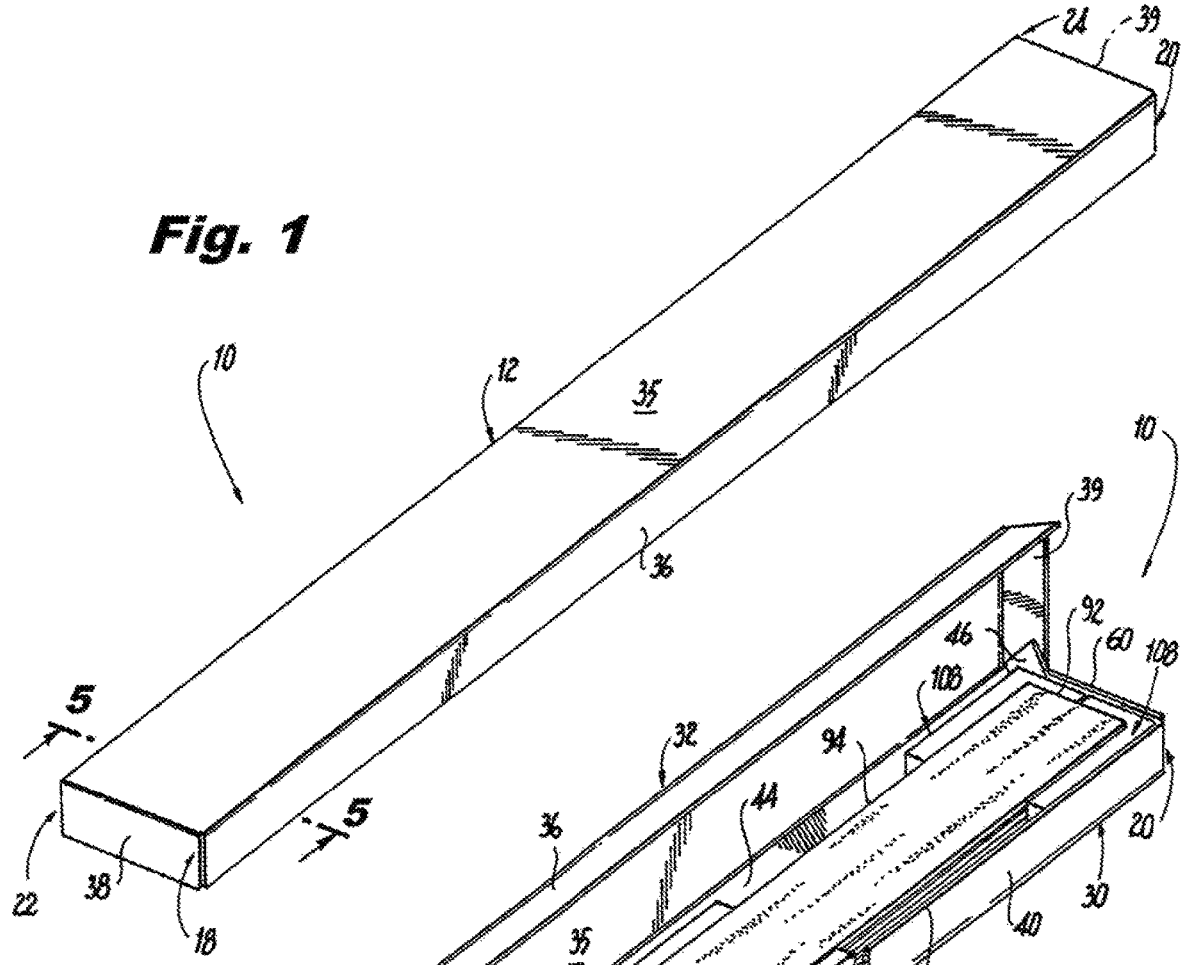
FIG. 1 is a simplified perspective view of a compression resistant package for wall and ceiling tile, in a closed condition, incorporating one embodiment of the present invention.

Referring to the drawings, a compression resistant package for wall and ceiling tile incorporating one embodiment of the invention is generally indicated by the reference number 10 in FIG. 1.

The package 10 includes a container 12 (FIG. 1) with four corner portions 18, 20, 22 and 24. The corner portions 18 and 20 are referred to as the front corner portions and the corner portions 22 and 24 are referred to as the back or rear corner portions. The container 12 also includes a box, portion 30 (FIG. 2) and a cover portion 32 for covering the box portion 30.

The box portion 30 (FIG. 2) has corner portions that correspond to the corner portions 18, 20, 22 and 24 ofthe container 12. For purposes of simplicity the reference numbers 18, 20, 22 and 24 for the corner portions of the container 12 (FIG. 1) will also refer to the corresponding corner portions of the box portion 30 (FIG. 2).

Figure 3:
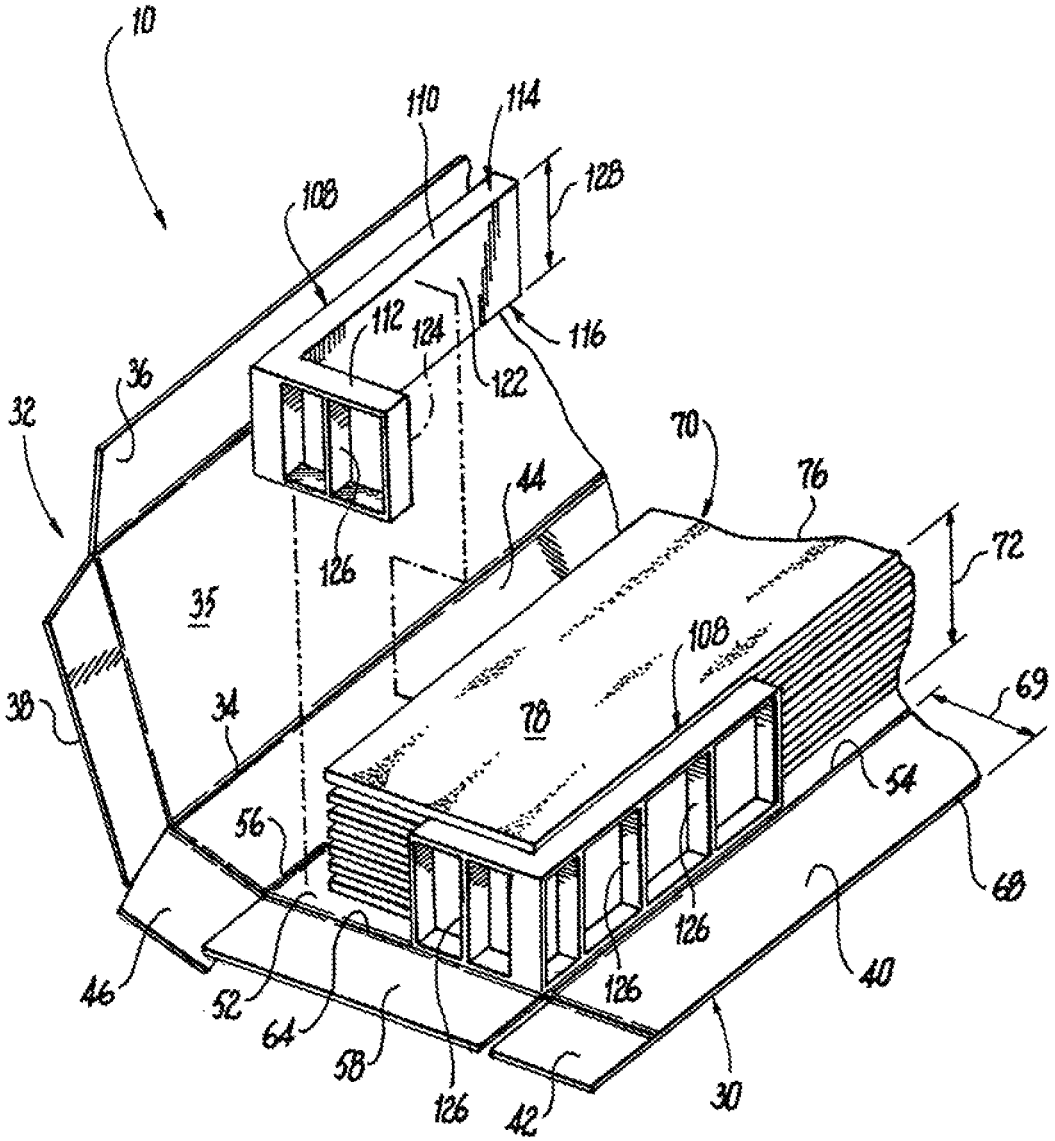
FIG. 3 is an enlarged fragmentary perspective view thereof, showing a corner protection member of the package in an exploded position away from the package interior.

The cover portion 32 of the container 12 is joined to the box portion 30 at a fold portion 34 (FIG. 3). Thus, the cover portion 32 and the box portion 30 of the container 12 are integral and developed from a single piece of material such as cardboard.

Figure 2:
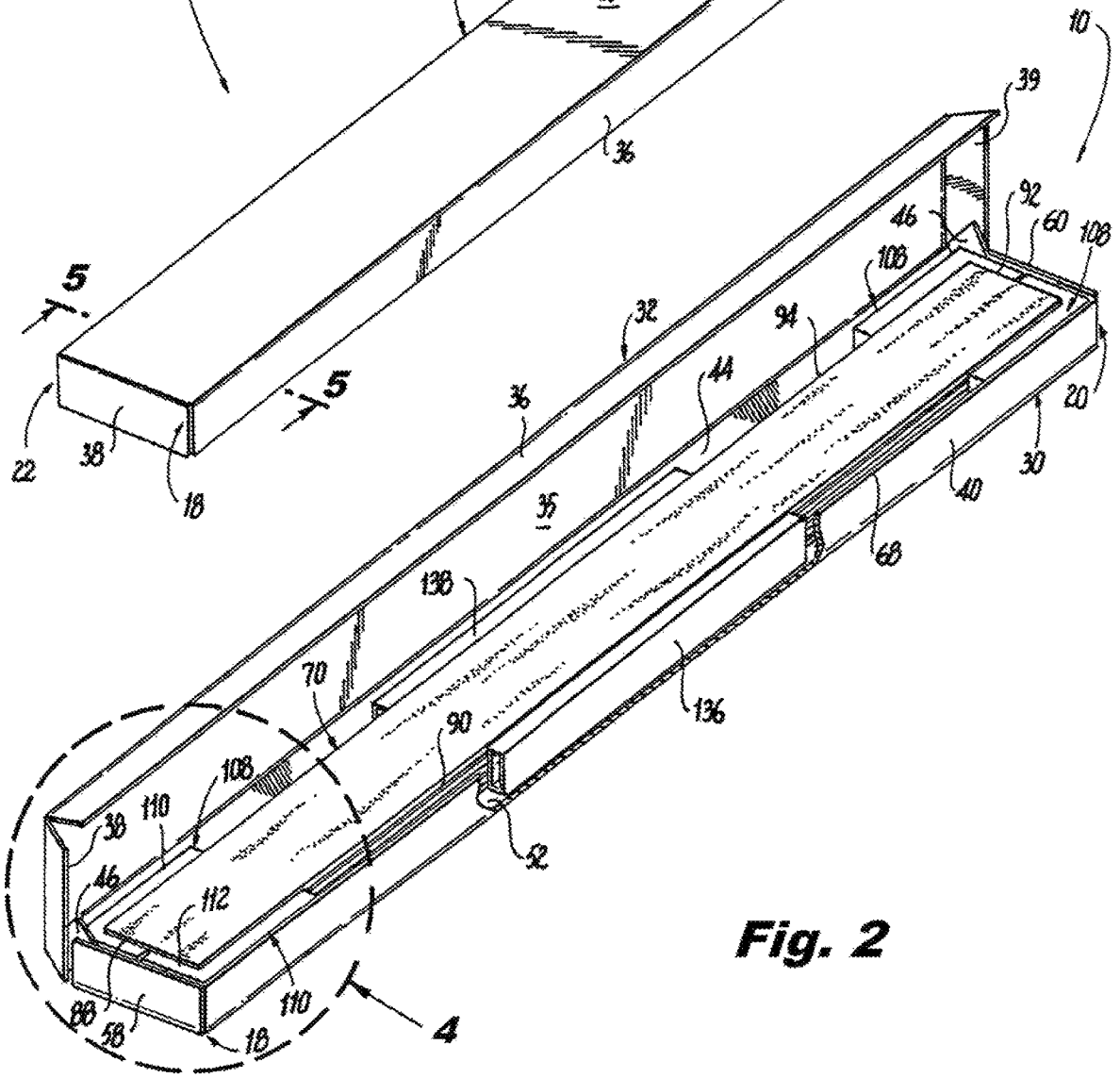
FIG. 2 is simplified perspective view thereof in an open condition, showing the package contents.

The cover portion 3 includes a top portion 35, a front flap 36 and opposite end flaps 38 and 39 (FIG. 2).

The box portion 30 includes an elongated front wall 40 (FIGS. 2-4) with a foldable end flap 42 (FIG. 3) at each opposite end of the front wall 40. The box portion 30 further includes an elongated rear wall 44 (FIGS. 2-3) with a foldable end flap 46 at each opposite end of the rear wall 44. The front wall 40 (FIG. 3) and the rear wall 44 are joined to a floor portion 52 of the box portion 30 at respective fold portions 54 and 56.

The box portion 30 also includes opposite end walls 58 and 60 (FIG. 2) joined to the floor portion 52 by a fold portion 64 (FIG. 3) at each opposite end of the floor portion 52.

The foldable end flap 42 (FIG. 3) at each opposite end of the of the front wall 40 and the foldable end flap 46 (FIG. 3) at each opposite end of the rear wall 14 are positionable against the end walls 58, 60 (FIGS. 2, 4) when the container 12 is in the closed position of FIG. 1.

Figure 4:
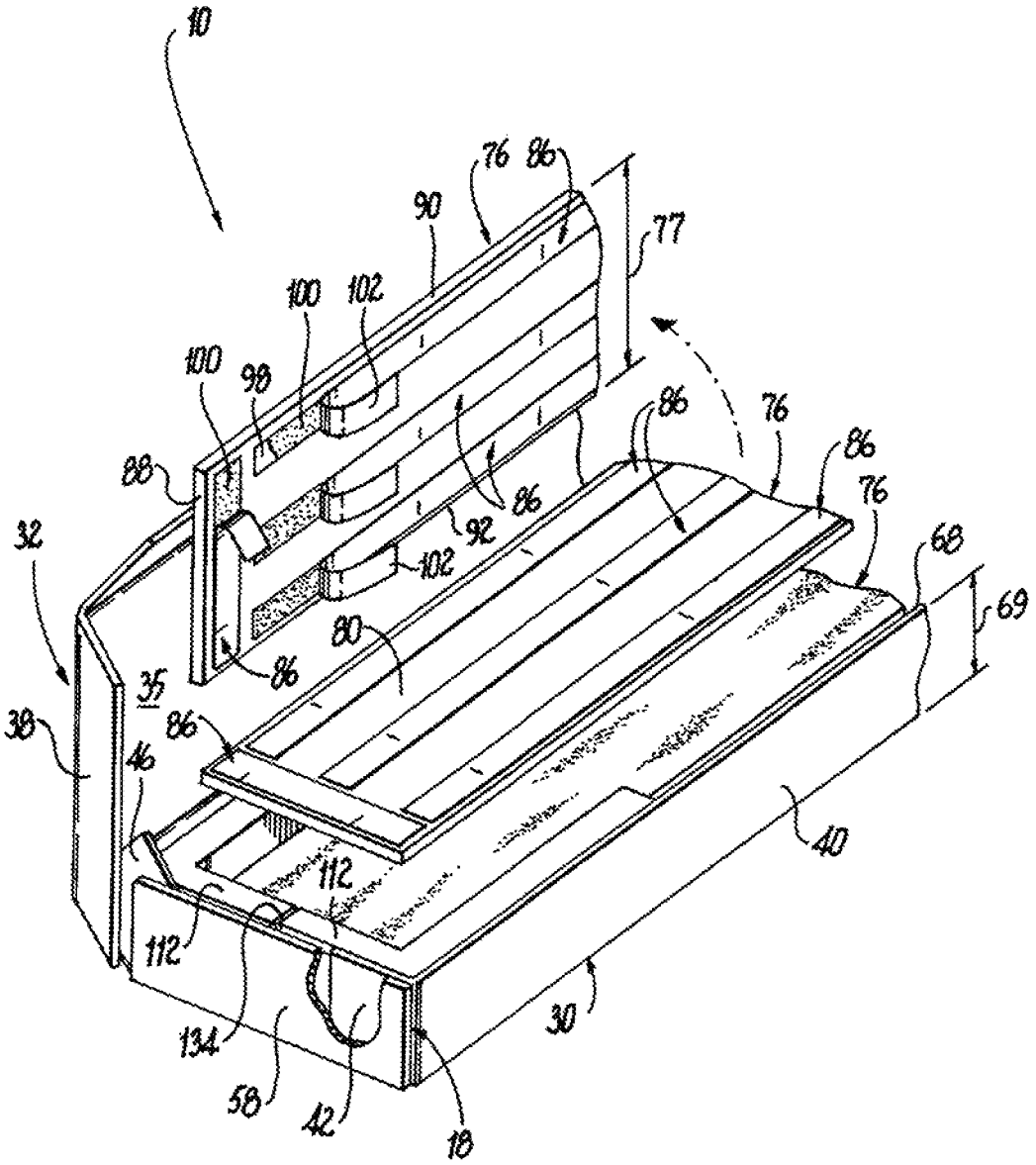
FIG. 4 is a simplified enlarged fragmentary perspective view thereof, showing two of the packaged wall and ceiling tiles exploded from the package interior.

Referring to FIGS. 2 and 4, the front wall 40 and the end walls 58, 60 of the box portion 30 extend upwardly from the floor portion 52 to define an upper edge 68 of the box portion 30. The upper edge 68 has an elevation 69 (FIG. 4) from the floor portion 52 (FIG. 3) of the box portion 30. The rear wall 44 (FIG. 3) of the box portion 30 also extends upwardly from the floor portion 52 to the same elevation 69 as the front wall 40. The elevation 69 is thus the elevation of the box portion 30.

Under this arrangement the container 12 can be fabricated from a single piece of cardboard to form a development of the box portion 30 and the cover portion 32.

The package 10 further includes a rectangular stack 70 (FIG. 3) of wall and ceiling tile members 76 (FIGS. 3-4). Each of the wall and ceiling tile members 76 is in the shape of a rectangle. The stack 70 of the tile members 76 has a predetermined height or elevation 72 (FIG. 3). The stack elevation 72 is slightly less than the elevation 69 (FIG. 4) of the box portion 30 to provide a slight clearance between the cover portion 32 and the tile stack 70.

The wall and ceiling tile member 76 is preferably formed of a plastic foam board material. Although the size of the wall and ceiling tile member 76 is a matter of choice, the tile member 76 can have a width 77 (FIG. 4) that is approximately 5 to 6 inches wide, a length 79 (FIG. 5) that is approximately 36 to 48 inches long and a thickness of approximately 3.0 millimeters.

The tile 76 has a front surface 78 (FIG. 3) with a design or display (not shown) that resembles a wood grain, natural stone or any other selected design or color.

The tile 76 also has a rear surface 80 (FIG. 4) that is provided with an adhesive tape securement system. The adhesive tape securement system comprises an array of strips of double-sided adhesive tape 86 (FIG. 4) located along peripheral edges 88, 90, 92 and 94 (FIGS. 2 and 4) of the tile 76 and at the middle of the rear surface 80 (FIG. 4) of the tile 76.

Figure 5:
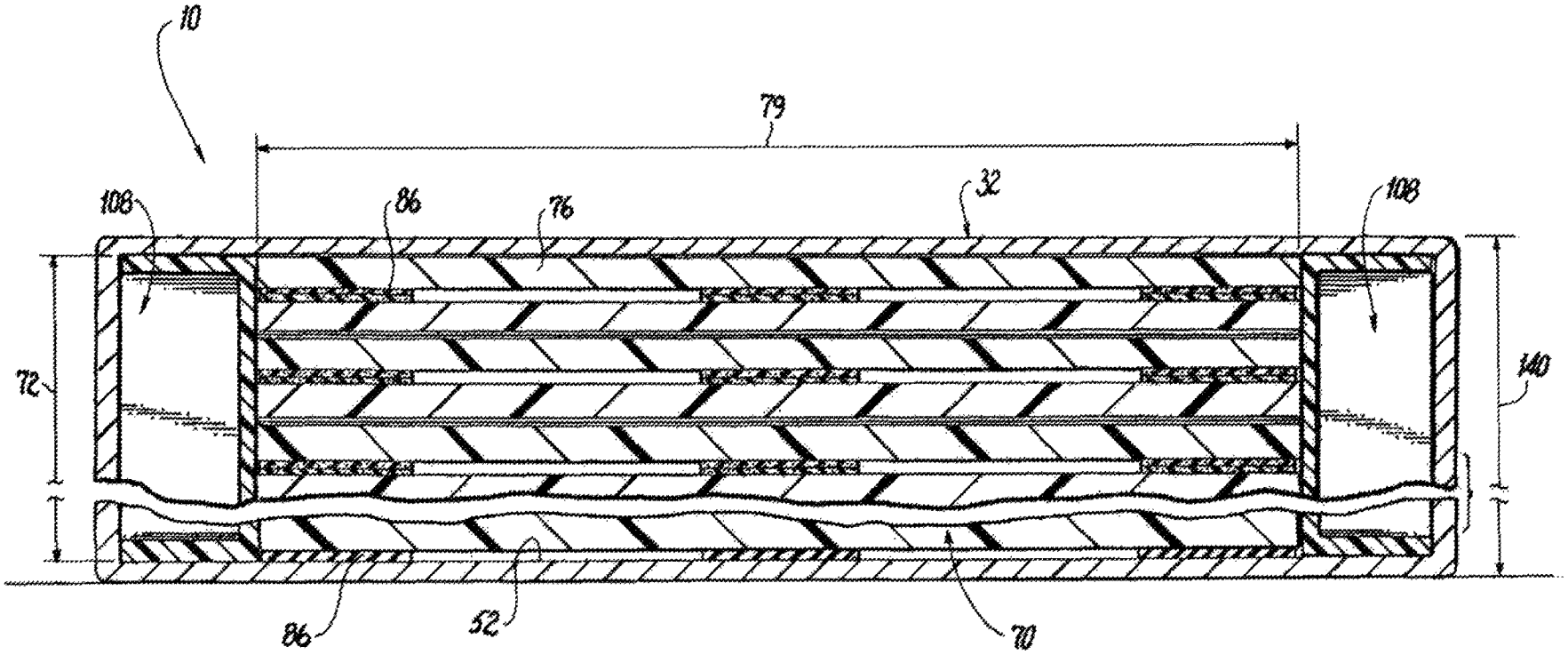
FIG. 5 is an enlarged fragmentary sectional view thereof taken on the line 5-5 of FIG. 1; and, FIG. 6 is a view similar to FIG. 5 showing, in simplified schematic fashion, the package of tiles being subjected to a downward compressive force by overlying, tile packages.
Figure 6:
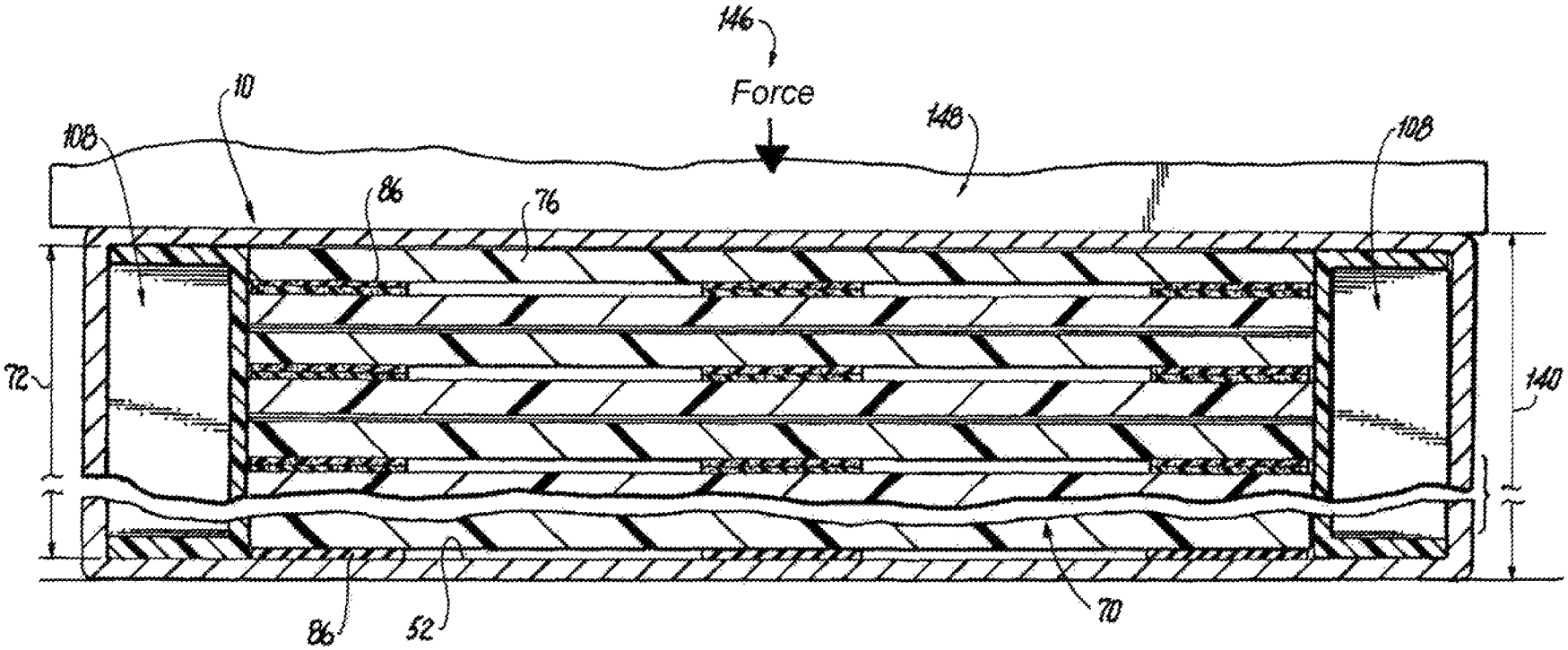

The double-sided adhesive tape 86 is a known product, such as the type made by the 3M Company under the product number 23069. The tape 86 has a flexible foam core 98 (FIGS. 4-6). The flexible foam core 98 is coated with adhesive 100 on two sides, with one adhesive side being adhered to the rear surface 80 of the tile 76, and the opposite adhesive side 100 being the exposed adhesive side (FIG. 4). The exposed adhesive side 100 of the tape 86 is covered with a detachable release paper 102 (FIG. 4).

The thickness of the foam core 98 of the double-sided adhesive tape 86 can be, for example, approximately 1/32 inch thick. The double-sided adhesive tape thus provides an approximate 1/32 inch clearance space between the rear surface 80 of the tile 76 and a wall or ceiling surface (not shown to which the tile 76 is secured by the tape 86.

The clearance space between the exposed adhesive side 100 of the tape 86 and the wall or ceiling surface is desirable because a wall or ceiling surface is generally not perfectly planar, and may also have other imperfections such as small bumps or recesses. The tape 86 is compliant against such imperfections, especially when the foam core 98 is at its normal thickness.

The foam core 98 of the tape 86 thus compressible and resilient to enable the adhesive side 100 of the tape 86 to fully embrace, in surface-to-surface contact, any bumps, recesses and non-planar portions of a wall and ceiling surface.

The compressibility and resiliency of the tape 86 thus enables the tape 86 to establish a full surface-to-surface adhesion to a wall or ceiling surffice. Full surface-to surface adhesion between the tape 86 and a wall or ceiling surface ensures a reliable and firm adhesive securement of the tile 76 to a wall or ceiling surface.

However, if the foam core 98 of the tape 86 has been under compression because of tile package compression before the tile 76 is installed, the resiliency of the foam core 98 can be compromised. In some instances a compressed foam core 98 will attain a compression set such that the thickness of foam core 98 is irreversibly reduced from its normal thickness.

A lasting reduction in the normal thickness of the foam core 98 can make it difficult to achieve full surface-to-surface contact between the tape 86 and a wall or ceiling surface. A compression set of the foam core 98 can thus be detrimental to attaining optimum tile adhesion to a surface during installation of the wall and ceiling tile 76.

The number of wall and ceiling tiles 76 that are stacked one upon another in the container 12 is a matter of choice, and is also based on the size of the container. For example, the container 12 can be sized to accommodate ten tiles 76 stacked to the full height 69 (FIG. 4) of the container 12.

Referring to FIG. 4, the tiles 76 are preferably stacked such that front surfaces 78 of the tiles 76 face each other and the rear surfaces of the tiles 76 face each other Thus, the release paper 102 on an underlying tile 76 makes surface contact with the release paper 102 of an overlying tile, as shown in FIG. 4. Other stacking arrangements are also feasible.

Generally, the weight of one tile 76 upon another tile 76 in a single package of tiles does not result in significant compression of any of the tiles 76 in the single package 10. However, the weight of overlying prior art packages of tiles is cumulative and can cause compression and/or deformation of underlying packages of prior art tiles resulting in significant compression of the individual tiles in the underlying prior art packages.

The package 10 further includes an. L-shaped corner protection and compression resistant member 108 (hereinafter referred to as a corner protection member) provided at each of the four corners 18, 20, 22 and 24 (FIG. 2) of the container 12. The corner protection member 108 is formed of a suitable rigid, lightweight, impact-resistant, and compression-resistant material, such as, for example, a high impact or impact resistant plastic material.

Each corner protection member 108 has a long leg 110 (FIG. 3) and a short leg 112 and opposite L-shaped horizontal top and bottom portions 114 and 116 (FIG. 3). Each of the corner protection members 108 also has a smooth L-shaped inside face that includes the smooth face 122 of the long leg 110 (FIG. 3) and the smooth face 124 of the short leg 112.

The long and short legs 110 and 112 of the corner protection members 108 are generally hollow and have exposed I-beam shaped reinforcing ribs 126 (FIG. 3) at an outside portion of the legs 110 and 112 that does not face the tile stack 70. The exposed I-beam shaped reinforcing ribs 126 of the corner protection members 108 face the walls 40, 44, 58 and 60 of the box portion 30 (FIGS. 2-4).

The long legs 110 and the short legs 112 of the corner protection members 108 have a height 128 (FIG. 3) from the bottom portion 116 of the corner protection member 108 to the top portion 114 of the corner protection member 108. The height 128 of the corner protection members 108 is slightly greater than the height 72 (FIG. 3) of the tile stack 70 to provide a slight clearance from the top portion 114 of the corner protection member 108 to the top of the tile stack 70. The height 128 of the corner protection members 108 is also substantially the same as the elevation 69 (FIG. 3) of the box portion 30.

Two of the corner protection members 108 (FIG. 2) are positioned at the front corners 18 and 20 of the box portion 30 with the long legs 110 between the tile stack 70 and the container front wall 40 (FIG. 2) and can be referred to as the front corner protection members. In similar fashion, the portion of the tile stack 70 nearest the front wall 40 (FIG. 2) of the box portion 30 can be referred to as the front of the tile stack. The portion of the tile stack 70 nearest the rear wall 44 (FIG. 2) can be referred to as the back of the tile stack 70.

The short legs 112 of the front corner protection members 108 are located between the tile stack 70 and the end walls 58 and 60. The other two corner members 108 that are positioned at the rear corners 22 and 24 of the box portion 30 are referred to as the rear corner members 108. The long legs 110 of the rear corner members 108 are positioned between the hack of the tile stack 70 and the rear wall 44 (FIG. 2) of the box portion 30.

The smooth faces 122 and 124 of the corner protection members 108 face the corner portions of tile stack 70 that correspond to the corners 18, 20, 22, and 24 (FIG. 1) of the container 12. The corner protection members 108 thus engage the four corner portions of the tile stack 70. The four corner protection members 108 are held in place in the container 12 by their engagement with the four corner portions of the tile stack 70 and also by their engagement with the four corner portions 18, 20, 22 and 24 at the inside of the container 12 (FIG. 2) when the container 12 is in the closed position of FIG. 1.

A clearance space 134 (FIG. 4) is provided between the free ends of the confronting short legs 112, 112 at each end wall 58, 60 of the box portion 30 to ensure that there is no interference between the free ends of the confronting short legs 112, 112.

The distance between the front wall 40 and the rear wall 44 of the box portion 30 is slightly larger than the width 77 (FIG. 4) of the tile 76 plus twice the thickness of the long leg 110 of the corner protection member 108.

It should be noted that the width of the tile stack 70 is the same as the width 77 (4) of an individual tile 76, and the length of the tile stack 70 is the same as the length 79 (FIG. 5) of an individual tile 76.

The distance between the end walls 58 and 60 of the box portion 30 is slightly larger than the length 79 of the tile stack 70 plus twice the thickness of the short leg 112 of the corner protection member 108.

The package 10 also includes a pair of elongated hollow inserts 136 and 138 (FIG. 2), preferably made of a light-weight material such as cardboard, The inserts 136 and 138 have a hollow rectangular cross-section. The insert 136 is provided in the space between the front of tile stack 70 and the front wall 40 of the box portion 30, and the insert 138 is provided in the space between the rear of the tile stack 70 and the rear wall 44 of the box portion 30.

The hollow inserts 136 and 138 have a thickness that is approximately the same as the thickness of the long legs 110 of the corner protection members 108. The inserts 136 and 138 have an elevation that is approximately the same as the elevation 69 (FIG. 4) of the front wall 40 from the floor portion 52 of the box portion 30.

As shown in FIG. 2, the box portion 30 of the container 12 is thus sized to provide a compact assemblage of the front and rear corner protection members 108, 108, 108, and 108, the tile stack 70, and the inserts 136, 138, when the package 10 is in the closed position of FIG. 1. Although not shown, tape can be applied to the package 10 to secure the front flap 36 and the end flaps 38, 39 to the bottom of the box portion 30.

Under this arrangement the corner protection members 108 embrace or surround the corner portions of the tile stack 70 and there is little or no free movement of the tile stack 70, the corner protection members 108, 108, 108, and 108 and the inserts 136, 138 within the box portion 30 of the container 12. Such compact assemblage enables the corner protection members 108 and the inserts 136, 138 to frame and protect the tile stack 70 that is enclosed in the taped package 10.

Since the corner protection members 108 surround and engage all four corner portions of the tile stack 70 within the package 10, as shown in FIGS. 2-4, they protect the corner portions of the tile stack 70 from external impacts against the corner portions 18, 20, 22 and 24 of the package 10. The corner protection members 108 thus protect the corners of the individual tile members 76 in the tile stack 70. Furthermore, the corner protection members 108 protect the corner portions of the individual tile members 76 in the tile stack 70 even after the package 10 is opened (FIG. 4) and some of the tile members 76 are removed.

It should also be noted that once the cover portion 32 of the package 10 is opened, as shown in FIG. 2, the rear wall 44 (FIG. 2) of the box portion 30 can pivot at the fold portion 56 (FIG. 3) in a direction away from the tile stack 70. Such pivotal movement of the rear wall 44 enables the rear corner protection members 108 to move away from the rear portion of the tile stack 70 to facilitate removal of the individual tile members 76 from the box portion 30.

As previously described, the height 128 (FIG. 3) of the corner protection members 108 is slightly greater than the height 72 (FIG. 3) of the tile stack 70. The height 128 of the corner protection members 108 is also substantially the same as the elevation 69 (FIG. 4) of the box portion 30.

FIG. 5 shows, in simplified schematic fashion, the tile stack 70 in the package 10 when the package 10 is not subject to any downward compressive force. As shown in FIG. 5, the tile stack 70 has a height 72 that extends from the floor portion 52 to the cover portion 32 of the package 10. The height of the package 10 is indicated by the reference number 140 (FIG. 5).

FIG. 6 shows, in simplified schematic fashion, the package 10 being subjected to a downward compressive force 146 due to the cumulative weight of a plurality of overlying packages 10 that are schematically indicated by the reference number 148.

It will be noted from FIG. 6 that the downward compressive force 146 from the overlying packages 148 is borne by the non-compressible corner protection members 108 of the underlying package 10. The non-compressible corner protection members 108 thus prevent compression of the underlying package 10 from the combined cumulative weight or force 146 of the overlying packages 148. The corner protection members 108 transfer the weight load from one package 10 to the corner protection members 108 of another package 10 when the packages are stacked on each other.

Under this arrangement the cumulative weight of the overlying packages 148 is borne by the corner protection members 108 and not by the tile stack 70 in any of the packages 10 that are loaded one upon another. Therefore, the overlying packages 148 do not cause compression of the tile stack 70 or the tiles 76 in the underlying package 10. Thus, the stack height 72 of the tile members 76 within the underlying package 10 remains substantially the same height before and after the package 10 is subject to the downward compressive force 146 from the overlying packages 148.

Furthermore, since the tile stack 70 in the underlying package 10 is not compressed by the overlying packages 148, the double-sided adhesive tape strips 86 are not compressed. Therefore, the normal thickness of the foam core 98 in the double-sided adhesive tape strips 86 on the tile members 76 in any underlying package 10 is preserved because of the weight bearing features and the compression resistant features of the corner protection members 108.

As various changes can be made in the above constructions and methods without departing from the scope of the invention, it is intended that all matter contained in the above description or shown in the accompanying drawings shall he interpreted as illustrative and not in a limiting sense.

What is claimed is:

1. A compression resistant package for wall and ceiling tile comprising, a) a first rectangular container formed of a non-rigid, compressible material and a stack of tiles stacked one upon another in the container, said first rectangular container having a first rectangular periphery, b) said first rectangular container having a box portion, said box portion having a floor portion and first and second opposite side walls and first and second opposite end walls extending upwardly from said floor portion, said first and second opposite side walls intersecting with said first and second opposite end walls to form four corners of said box portion, c) said opposite side walls and said opposite end walls having an upper edge portion at a first predetermined height from said floor portion, d) an L-shaped corner protection member provided inside the box portion at each of the four corners of said box portion, each said L-shaped corner protection member being formed of a rigid material and having two intersecting legs, and one of the intersecting legs of each said corner protection member extends a first predetermined distance alongside one of the opposite side walls and the other of the intersecting legs of each said corner protection member extends a second predetermined distance alongside one of the opposite end walls at each of the four corners of said box portion, e) said L-shaped corner protection members having a height that extends upwardly from the floor portion of said box portion to the first predetermined height of said end walls and said side walls, such that the L-shaped corner protection members also have the first predetermined height, f) said first rectangular container further including a cover at the upper edge portion of the box portion to cover the box portion and the L-shaped corner protection members, g) said stack of tiles having a second rectangular periphery with corner portions that respectively extend into respective ones of said L-shaped corner protection members at the four corners of said box portion, said stack of tiles having a second height from the floor portion of said box portion that is less than the first predetermined height of said corner protection members, and h) the rigid material of said corner protection members is non-compressible plastic to enable the corner protection members to be compression resistant to the weight of any overlying containers overlying the first rectangular container and having a rectangular periphery similar to the first rectangular periphery of said first rectangular container, such that the corner protection members prevent any overlying containers from compressing the first rectangular container and imposing pressure on the stack of tiles inside the first rectangular container when the stack of tiles inside the first rectangular container have the second height that is less than the first predetermined height of said corner protection members.

2. The compression resistant package as claimed in claim 1, wherein a spacer member is provided inside the box portion of the first rectangular container alongside each said opposite side wall, each said spacer member having opposite ends that are spaced a predetermined distance from the L-shaped corner protection members.

3. The compression resistant package as claimed in claim 2, wherein the spacer member is formed of a tubular cardboard material, said spacer member having a hollow rectangular cross-section and extends upwardly from the floor portion of said box portion to the first predetermined height of said opposite end walls and said opposite side walls.

4. The compression resistant package as claimed in claim 2, wherein the opposite side walls of the box portion are longer than the length of the opposite end walls and the spacer members are longer than the length of the opposite end walls.

5. The compression resistant package as claimed in claim 1, wherein the two intersecting legs of said L-shaped corner protection member are perpendicular to each other.

6. The compression resistant package as claimed in claim 1, wherein a first one of said corner protection members is at a first corner of said box portion wherein a first of the opposite side walls intersects a first of the opposite end walls, a first of the intersecting legs of said first corner protection member extends the first predetermined distance alongside the first side wall and a second of the intersecting legs of said first corner protection member extends the second predetermined distance alongside the first end wall, a second of said corner protection members is at a second corner of said box portion wherein the first sidewall intersects the second end wall, and the first intersecting leg of said second corner protection member extends the first predetermined distance alongside the first side wall and the second intersecting leg of said second corner protection member extends the second predetermined distance alongside the second end wall, and a third of said corner protection members is at a third corner of said box portion wherein the second side wall intersects the first end wall, and the first intersecting leg of said third corner protection member extends the first predetermined distance alongside the second side wall and the second intersecting leg of said third corner protection member extends the second predetermined distance alongside the first end wall, and a fourth of said corner protection members is at a fourth corner of said box portion wherein the second side wall intersects the second end wall, and the first intersecting leg of said fourth corner protection member extends the first predetermined distance alongside the second side wall and the second intersecting leg of said fourth corner protection member extends the second predetermined distance alongside the second end wall.

7. The compression resistant package as claimed in claim 6, wherein the first and second intersecting legs of each said corner protection member have free ends, and a first spacer member is provided inside the box portion of the container alongside the first side wall, between the free ends of the first intersecting legs of the first and second corner protection members, and a second spacer member is provided inside the box portion of the container alongside the second side wall, between the free ends of the first intersecting legs of the third and fourth corner protection members.

8. The compression resistant package as claimed in claim 1, wherein the intersecting legs of the corner protection member have top and bottom portions joined by a face portion, and the intersecting legs of the corner protection member are substantially hollow, said corner protection member further includes at least one noncompressible reinforcing rib in each said intersecting leg, said reinforcing rib extending from the bottom portion to the top portion of the corner protection member.

9. The compression resistant package as claimed in claim 8, wherein the intersecting legs of the corner protection member are perpendicular to each other and define an inside right angle and an outside right angle, the inside right angle portion of the corner protection member forming the face portion of the corner protection member.

10. The compression resistant package as claimed in claim 9, wherein the face portion of the corner protection member is planar at each intersecting leg.

11. The compression resistant package as claimed in claim 8, wherein the height of the corner protection member is the distance between the bottom portion and the top portion of the corner protection member.

12. The compression resistant package as claimed in claim 1, wherein said corner protection members are individually insertable into and removable from the box portion of said container.

13. The compression resistant package as claimed in claim 1, wherein said corner protection members and said box portion are sized such that the corner protection members can surround corresponding corner portions of the stack of tiles to embrace the corner portions of the stack of tiles packaged in the box portion and thereby protect the corner portions of the stack of tiles from any external impacts against the corner portions of the box portion.

14. The compression resistant package as claimed in claim 1, wherein the opposite side walls of the box portion are longer than the length of the opposite end walls.

15. The compression resistant package as claimed in claim 1, wherein the non-rigid, compressible material of the first rectangular container is formed of cardboard material.

16. The compression resistant package as claimed in claim 1, wherein the opposite side walls and the opposite end walls are hinged to the floor portion to permit movement of the opposite side walls and the opposite end walls from a vertical orientation wherein the opposite sidewalls and the opposite end walls are perpendicular to the floor portion, to a horizontal orientation wherein the opposite side walls and opposite end walls are co-planar with the floor portion.

17. The compression resistant package as claimed in claim 1, wherein the tiles in the stack of tiles have an adhesive tape securement system that includes double-sided adhesive tape with a foam core.

18. A compression resistant package for wall and ceiling tile comprising, a) a first rectangular container formed of a non-rigid, compressible, material and a stack of tiles stacked one upon another in the container, said first rectangular container having a first rectangular periphery, b) said first rectangular container having a box portion, said box portion having a floor portion and first and second opposite side walls and first and second opposite end walls extending upwardly from said floor portion, said first and second opposite side walls being of greater length than the first and second opposite end walls and intersecting with said first and second opposite end walls to form four corners of said box portion, c) said opposite side walls and said opposite end walls having an upper edge portion at a first predetermined height from said floor portion, d) an L-shaped corner protection member provided inside the box portion at each of the four corners of said box portion, each said L-shaped corner protection member being formed of a rigid material and having two intersecting legs, and one of the intersecting legs of each said corner protection member extends a first predetermined distance alongside one of the opposite side walls and the other of the intersecting legs of each said corner protection member extends a second predetermined distance alongside one of the opposite end walls at each of the four corners of said box portion, e) said L-shaped corner protection members being insertable in and removable from the box portion of said first rectangular container and said L-shaped corner protection members having a height that extends upwardly from the floor portion of said box portion to the first predetermined height of said end walls and said side walls, f) said first rectangular container further including a cover at the upper edge portion of the box portion to cover the box portion and the L-shaped corner protection members, g) said stack of tiles having a second rectangular periphery with corner portions that respectively extend into respective ones of said L-shaped corner protection members at the four corners of said box portion, said stack of tiles having a second height from the floor portion of said box portion that is less than the first predetermined height of said corner protection members, and h) the rigid material of said corner protection members is non-compressible plastic to enable the corner protection members to be compression resistant to the weight of any overlying containers overlying the first rectangular container and having a rectangular periphery similar to the first rectangular periphery of said first rectangular container, such that the corner protection members prevent any overlying containers from compressing the first rectangular container and imposing pressure on the stack of tiles inside the first rectangular container when the stack of tiles inside the first rectangular container have the second height that is less than the first predetermined height of said corner protection members.

19. The compression resistant package as claimed in claim 18, wherein a spacer member is provided inside the box portion of the first rectangular container alongside each said opposite side wall, each said spacer member having opposite ends that are spaced a predetermined distance from the L-shaped corner protection members.

20. The compression resistant package as claimed in claim 18, wherein the intersecting legs of the corner protection member have top and bottom portions joined by a face portion, and the intersecting legs of the corner protection member are substantially hollow, said corner protection member further include at least one noncompressible reinforcing rib in each said intersecting leg, said reinforcing rib extending from the bottom portion to the top portion of the corner protection member.

* * * * *